US005236379A

United States Patent [19]

Harris et al.

[11] Patent Number: 5,236,379

[45] Date of Patent: Aug. 17, 1993

[54] PERSONAL WATERCRAFT GULLET

[75] Inventors: Norman D. Harris; Robert T. Harris, both of 31750 Machado St. #38, Lake Elsinore, Calif. 92530

[73] Assignees: Norman D. Harris; Robert T. Harris; Timothy J. McCall, Lake Elsinore, Calif.

[21] Appl. No.: 787,381

[22] Filed: Nov. 4, 1991

[51] Int. Cl.[5] ..... B63H 11/103

[52] U.S. Cl. ..... 440/47; 114/270

[58] Field of Search ..... 114/270; 60/221, 222; 440/38, 40–43, 46, 47

[56] References Cited

U.S. PATENT DOCUMENTS

| | | | |
|---|---|---|---|
| 3,147,733 | 9/1964 | Engel | 440/46 |
| 3,174,454 | 3/1965 | Kenefick | 440/46 |
| 3,187,708 | 6/1965 | Fox | 440/46 |
| 3,601,989 | 8/1971 | Austin | 60/221 |
| 3,827,390 | 8/1974 | De Vault | 440/43 X |
| 3,942,463 | 3/1976 | Johnson, Jr. | 440/47 |
| 3,978,814 | 9/1976 | Willyard | 440/47 |
| 4,182,118 | 1/1980 | Chronic | 60/221 |
| 4,237,812 | 12/1980 | Richardson | 440/38 |
| 4,315,749 | 2/1982 | Baker et al. | 440/41 X |
| 4,325,699 | 4/1982 | Castoldi | 440/47 |
| 4,437,841 | 3/1984 | Stallman | 440/42 |
| 4,449,944 | 5/1984 | Baker et al. | 440/47 |
| 4,775,341 | 10/1988 | Tyler et al. | 440/38 |
| 4,971,584 | 11/1990 | Inoue et al. | 440/46 X |

FOREIGN PATENT DOCUMENTS

| | | | |
|---|---|---|---|
| 2911830 | 10/1980 | Fed. Rep. of Germany . | |
| 34898 | 2/1987 | Japan | 114/270 |
| 293351 | 5/1927 | United Kingdom . | |
| 1094169 | 9/1966 | United Kingdom . | |
| 1460947 | 1/1977 | United Kingdom . | |

OTHER PUBLICATIONS

D. Ford, *Fine-Tuning Your Pump Inlet With Targa's Vortex Generator,* Personal Watercraft Illustrated, 78–79 (Oct. 1990).

"Hydraulic Jet Propulsion: A Theoretical and Experimental Investigation Into the Propulsion of Seacraft by Water Jets," by A. Gasiunas, et al., published in vol. 178, Part I, the Institution of Mechanical Engineers.

*Primary Examiner*—Sherman Basinger

*Attorney, Agent, or Firm*—Knobbe, Martens, Olson & Bear

[57] ABSTRACT

An outlet for a personal watercraft which reduces water turbulence entering a hydro-jet propulsion system. The gullet comprises a entry edge fin have a blunt nose for improving hydrodynamic flow through the gullet. The nose has an apex positioned at or above a keel line of the watercraft, and preferably positioned closer to the keel line than to a floor of the gullet. The gullet also has a generally constant area along its length to maintain substantially constant pressure over its length and to provide low resistance to water flow through the gullet.

11 Claims, 6 Drawing Sheets

PERSONAL WATERCRAFT GULLET

BACKGROUND OF THE INVENTION

1. Field of the Invention

The present invention relates to personal watercraft, and more particularly to hydro-jet propulsion systems of personal watercraft.

2. Description of Related Art

Personal watercraft resemble small power boats, having hulls similar in shape but generally smaller than boat hulls. In use, a rider stands, sits or kneels near the stern of the watercraft when riding.

A hydro-jet propulsion system typically powers the watercraft. The propulsion system comprises a motor which drives a pump located in the aft section of the hull. An intake gullet in the bottom of the hull provides a passageway for water entering the pump; the pump, in turn, forces the water through a jet nozzle, thereby propelling the watercraft forward.

Prior gullet designs do not optimize water flow characteristics in the gullet to improve pump efficiency. Typical prior gullet designs have irregular shape intake apertures opening into the gullet and obstructive safety features. Moreover, in some prior gullet designs, the entry edges (i.e., the edges in which water strikes) of the intake aperture are sharp, and, in the plane of the intake aperture, are oblique to the water flowing into the gullet. These designs cause turbulence, air entrainment and other instabilities in the water flow entering the pump.

Turbulent water entering the pump decreases pump performance, as known in the art. Additionally, violent turbulence creates cavitations in the water; cavitation, or bubbles internal to the flow, occurs when the local water pressure decreases below that of the water vapor pressure. Cavitation decreases the volume of liquid flowing through the pump, further reducing its efficiency. Cavities also violently collapse when reaching the pump, imploding and damaging the pump.

SUMMARY OF THE INVENTION

The gullet entry edge foil of the present invention comprises a nose portion having a blunt configuration for improving hydrodynamic flow through the intake. The blunt nose configuration produces a substantially laminar flow over the nose and in the gullet before a pump inlet.

In a preferred embodiment, the nose comprises an apex positioned at or above a keel line of the personal watercraft. The entry edge foil also has a substantially linear configuration in the lateral direction, and is substantially perpendicular to the water flow.

Another aspect of the present invention involves an entry edge foil which comprises a nose portion formed by arcuate surface portions having different radii of curvature. In a preferred embodiment, a first of the surface portions comprises a keel surface portion, a second of the surface portions comprises a gullet surface portion, and a third of the surface portions comprises an apex surface portion positioned between the keel surface portion and the gullet surface portion. The apex surface portion has a radius of curvature significantly smaller than the radii of curvature of the keel surface portion and the gullet surface portion. The keel surface portion also has a radius of curvature significantly smaller than the radius of curvature of the gullet surface portion. The nose portion has an apex positioned closer to the keel line than to a gullet floor of the propulsion system. The apex surface portion has a radius center distanced from the apex surface portion by its radius of curvature with the radius center being offset from the keel line of the watercraft.

In a further aspect of the invention, the entry edge comprises a foil having an asymmetric cross-sectional shape about a chord line. A portion of the foil is defined between a gullet surface portion and a keel surface portion with the chord line positioned proximate to the keel surface portion.

The foil has a maximum transverse thickness defined between the keel surface portion and a gullet surface portion, significantly larger than a maximum transverse distance between the chord line and the keel surface portion. The ratio between the maximum transverse distance and the maximum transverse thickness is preferably on the order of about twenty-five (25) percent.

In accordance with an additional aspect of the invention, the hydraulic intake comprises a hull having a bottom surface defining an intake aperture. A foil positioned perpendicular to the water flow, defines an entry edge of the aperture. The hydraulic intake additionally comprises a gullet communicating with the aperture and a pump inlet. The gullet has a substantially uniform flow area between the intake aperture and the pump inlet, so as to produce a substantially laminar flow of water passing through the gullet between the foil and the pump inlet.

In accordance with yet another aspect of the present invention, the hydraulic intake system comprises a gullet having a forward ramp and a drive shaft extending from the forward ramp generally in the longitudinal direction. The intake additionally comprises a gullet fin extending from the forward ramp and being disposed about the drive shaft. The gullet fin has an air foil cross-sectional shape with a camber line curving partially around the drive shaft. The cross-sectional shape of the gullet fin is configured to produce a laminar flow downstream of the drive shaft.

In a preferred embodiment, the gullet fin comprises an inner surface having a concave portion proximate to a tail of the gullet fin to reduce the size of a wake downstream of the drive shaft. Thus, as viewed in cross-section, the gullet fin generally has a paisley shape.

The intake additionally comprises a second gullet fin having a shape similar, but inverse of, the first fin. The first fin and the second fin are disposed diametrically opposite from each other about the drive shaft. The fins are preferably sufficiently spaced in the lateral direction from each other and from the drive shaft to prevent hand-sized objects from entering the pump inlet downstream of the gullet. The first fin and the second fin each comprise tails. The tails are disposed in the transverse direction proximate to a longitudinal axis of the drive shaft and disposed in the lateral direction proximate to the surface of the drive shaft.

In accordance with a further aspect of the present invention, there is provided a kit for modifying an existing personal watercraft propulsion system. The kit comprises an entry edge insert having a nose portion with a blunt configuration for improving hydrodynamic flow through the intake. The kit additionally comprises a hull modification insert having a smooth forward ramp surface and defining an aperture to receive a drive shaft of the propulsion system. The hull insert is configured to produce a gullet having a substantially uniform flow area throughout its longitudinal length, thereby producing a region of substantially constant pressure before the pump.

In a preferred embodiment, the nose portion is perpendicular to the water flow in the lateral direction. The hull insert comprises gullet fins extending across the gullet and being positioned to prevent hand-sized objects from entering the propulsion system. Preferably, each gullet fin has an air foil cross-sectional shaped with a camber line curving around the drive shaft. The configuration of the fin's cross-sectional shape produces a substantially laminar flow downstream of the drive shaft.

BRIEF DESCRIPTION OF THE DRAWINGS

These and other features of the invention will now be described with reference to drawings of preferred embodiments which are intended to illustrate, and not to limit, the invention, and in which.

DETAILED DESCRIPTION OF THE DRAWINGS

Figure 1:
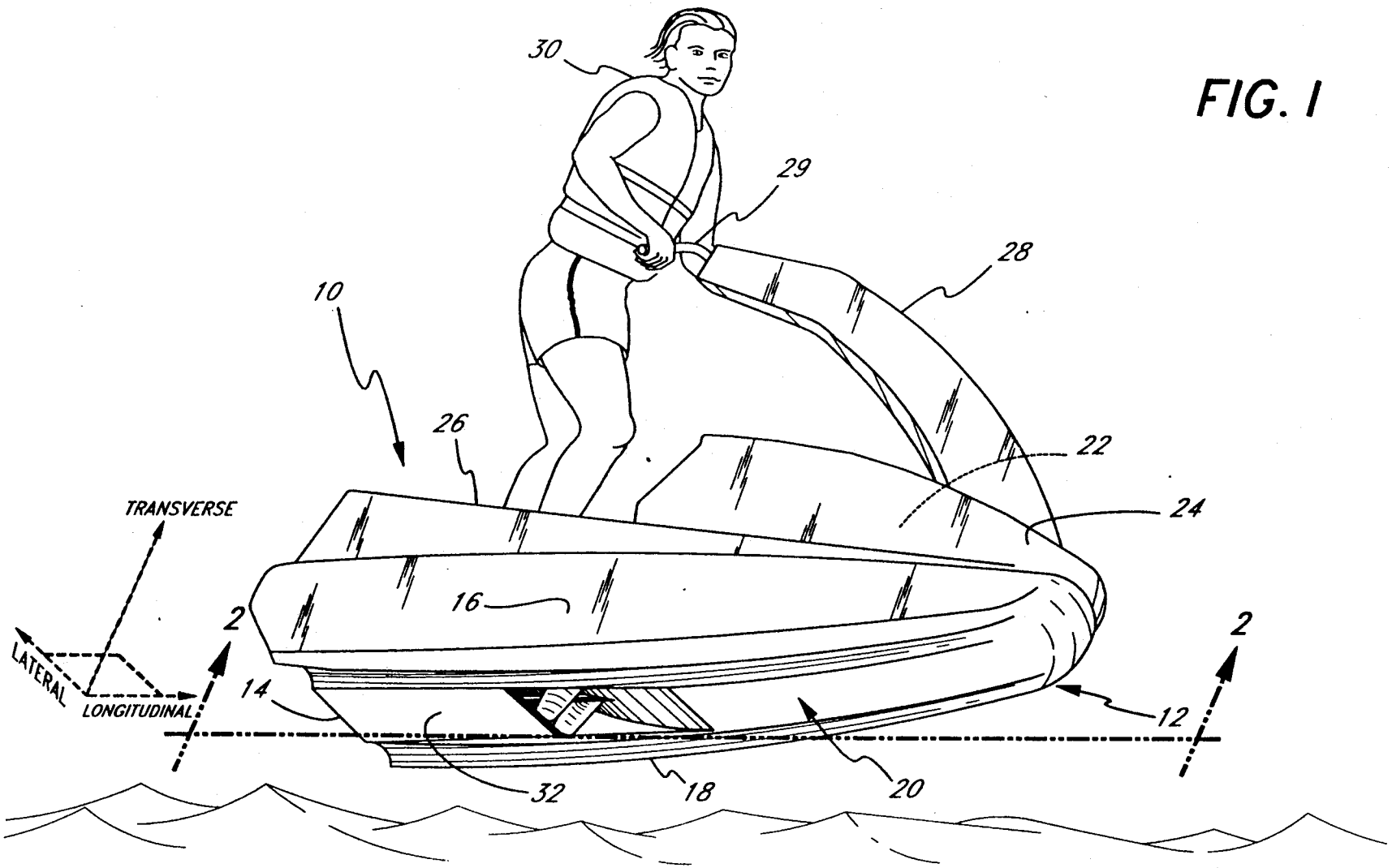
FIG. 1 is a perspective view of a personal watercraft.

FIG. 1 illustrates a personal watercraft 10 of the present invention having an improved gullet design to increase the efficiency of a propulsion system and thereby improve the performance of the vehicle. Although the discussion of the present invention proceeds in connection with one embodiment of a personal watercraft (i.e., in connection with a Jet-Ski®), those skilled in the art will appreciate that the invention can be adapted for use with other embodiments of personal watercraft, as well as for use with power boats and the like.

For the purpose of describing the invention, a coordinate system is provided having mutually orthogonal coordinates oriented as follows: a "longitudinal" coordinate extending in the direction between a bow 12 and a stern 14 of the watercraft 10; a "lateral" coordinate extending in the direction between a port side 16 and a starboard side 18, and intersecting the longitudinal coordinate at right angles; and a "transverse" coordinate orthogonal to both the longitudinal coordinate and the lateral coordinate. Additionally, as used herein, "forward" and "rearward" refer to the direction towards or away from the bow 12, respectively, along the longitudinal coordinate, and "above" and "below" refer to positions along the transverse coordinate, "above" being in the direction out of the water and "below" being in the direction into the water.

The watercraft 10 illustrated in FIG. 1 comprises a hull 20 which floats in the water of a lake, ocean, or the like, during use. The hull 20 supports a motor 22 enclosed by a housing 24 towards the bow 12 of the watercraft 10 and a rider platform 26 positioned proximate the stern 16. A steering arm 28 rotatably couples with a forward section of the motor housing 26 and extends upwardly from the bow 12 of the watercraft 10 at a rearward angle. A rider 30 stands, kneels, squats, sits or lies on the rider platform 26 holding onto a steering bar 29. The rider 30 steers the watercraft 20 by pulling back on either side of the steering bar 29 to rotate a directional jet nozzle of the watercraft propulsion system.

Figure 2:
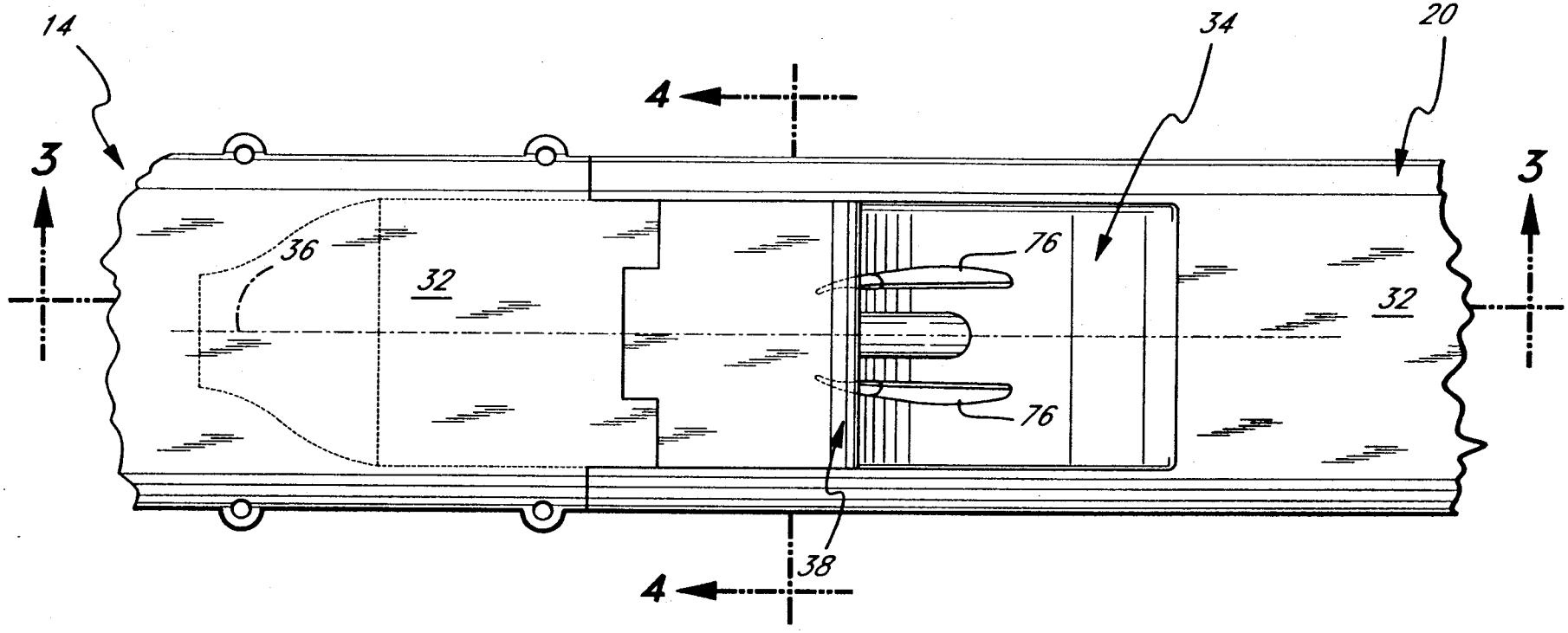
FIG. 2 is a partial bottom view of a personal watercraft in accordance with an embodiment of the present invention taken along the line 2—2 of FIG. I.

Referring to FIGS. 1 and 2, the hull 20 includes a generally flat, smooth bottom surface 32 extending from the stern 14 towards the bow 12 of the watercraft 10. As viewed from the bottom of the watercraft 10, the surface 32 of the hull 20 generally has a "v"-shape, tapering outwardly from the bow 12 to the stern 14. As viewed from the side of the watercraft 10, the surface 32 of the hull 20 has an arcuate shape similar to a half of a parabola, beginning at the bow 12 and extending towards the stern 14. In use, the bottom surface 32 is submerged. The bottom surface 32, as best seen in FIG. 2, has an intake aperture 34 positioned symmetrically about a keel line 36 and located proximate to the stern 14. As used herein, "keel line" refers to a generally longitudinal line lying in the bottom surface 32 and longitudinally bisecting the bottom surface 32. The intake aperture 34 has a generally rectangular shape with the longer side of the intake aperture 34 being parallel to the keel line 34. The corners of the aperture 34 are preferably rounded. An entry edge fin 38 forms a substantially linear rearward edge of the intake aperture 34. The entry edge fin 38 has a blunt nose 54 which extends along the entire length of the rearward edge of the entry aperture, normal to the direction of water flow over the bottom surface 32.

Figure 3:
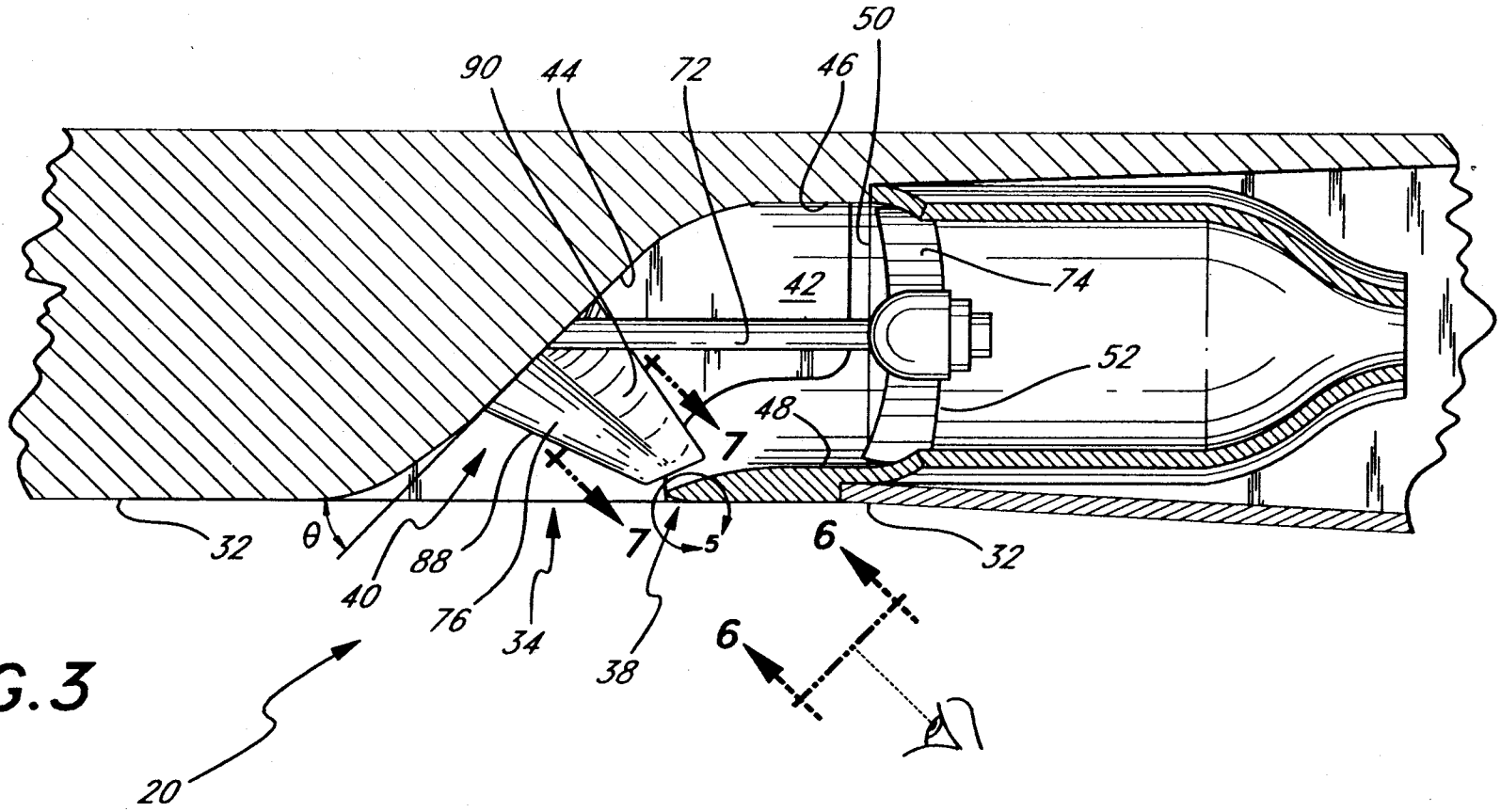
FIG. 3 is a cross-sectional view of a gullet of the personal watercraft of FIG. 2 taken along the line 3—3.

Referring to FIG. 3, the aperture 34 opens into a low resistance gullet 40 defined by a pair of sidewalls 42, a forward ramp 44 transitioning to a ceiling 46, and a floor 48, which is formed by the entry edge fin 38. The gullet 40 terminates at the cylindrical inlet 50 of a pump 52. The gullet 40 forms a smooth, elbow-shape tunnel configuration beginning at the intake aperture 34 and extending upward from the keel line 36 at an intake angle $\theta$ before bending to a horizontal path forward of the pump 52. The forward ramp 44 of the gullet 40 forms the intake angle $\theta$ with the keel line 36. The intake angle $\theta$ ranges between 10° and 80°, and preferably equals about 45°.

Figure 4:
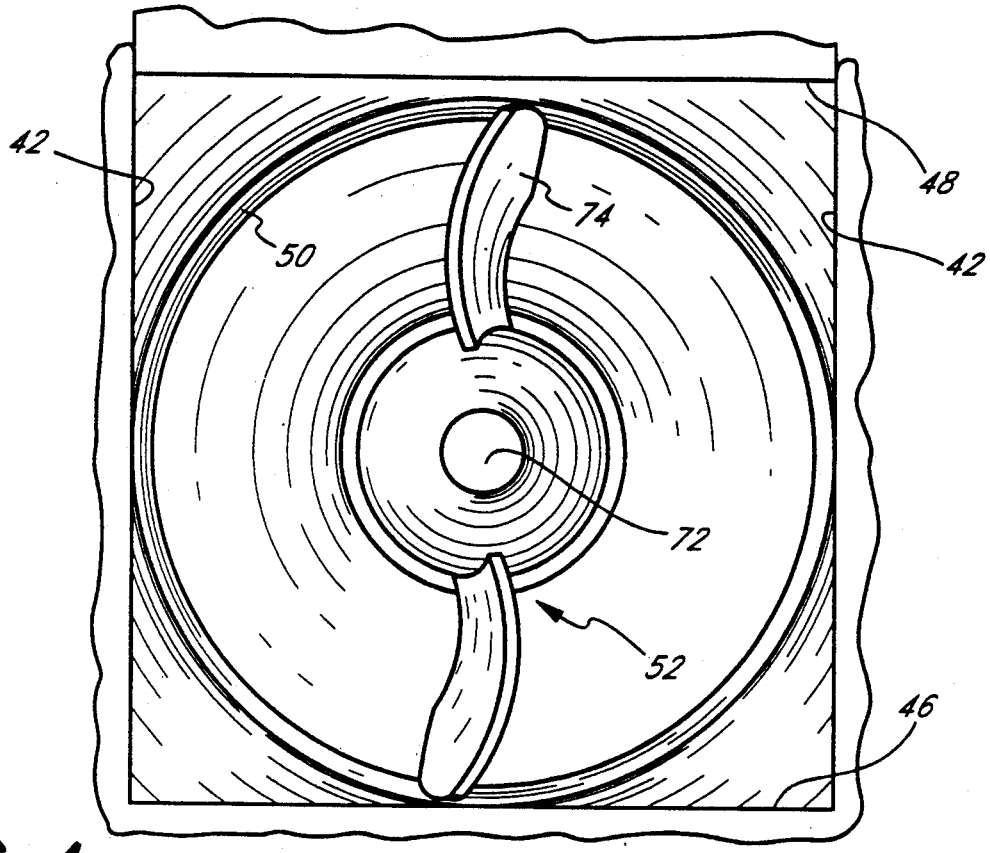
FIG. 4 is a cross-sectional view of the gullet of FIG. 2 taken along line 4—4.

Referring to FIG. 4, the gullet 40 has a rectangularly shaped flow area proximate to the aperture 34 and smoothly transforms to a circular area proximate to the pump 52. As used herein, the "flow area" of the gullet is taken across a plane perpendicular to the water flow through the gullet. As best seen in FIG. 3, the gullet 40 advantageously does not include any significant surface irregularities which would cause cavitations or turbulence in the water flow through the gullet 40. In addition, the gullet 40 has a substantially uniform flow area from the intake aperture 34 to the pump inlet 50, such that water flowing though the gullet 44 does not undergo drastic changes in pressure. The gullet 40 therefore provides a low resistance passageway for water flowing in the intake aperture 34 towards the pump 50.

The low flow resistance produces substantially laminar flow through the gullet upstream of the pump 52, and increases the performance of the pump 52 by reducing turbulence caused by irregularities and adverse pressure gradients in the gullet passageway.

As illustrated in FIG. 3, the gullet floor 48 extends from the blunt nose 54 of the entry edge fin 38, parallel to the keel line 36, towards the stern 14. The gullet floor 48 has a generally flat surface proximate to the nose 54 of the entry edge fin 38 and smoothly transforms to an arcuate surface conforming to the cylindrical shape of the pump inlet 50. The bottom surface 32 extends along the keel line 36 below the gullet floor 48. Preferably, the pump 52 is positioned so that the periphery of the bottom of the pump inlet 50 is proximate to the bottom surface 32. Positioning the pump 52 in this manner permits the thickness of the entry edge fin 38 to be small compared to the diameter of the pump inlet and in the preferred embodiment, the fin has a transverse thickness which is on the order of 20% or less of the pump inlet diameter. Preferably, the entry edge fin 38 is sufficiently thin to define a foil, as discussed in greater detail below.

As mentioned above, the ramp 44 and ceiling 46 of the gullet 40 are configured to define a uniform flow area along the length of the gullet passage. The front ramp 44 smoothly ascends at the intake angle $\theta$ into the hull 20 and transitions to a flat horizontal surface forming the gullet ceiling 46. The ceiling 46, in turn, extends towards the stern 14 and-transforms from the flat surface to an arcuate surface, conforming to the cylindrical shape of the pump inlet 52. Proximate to the intake aperture 34, each sidewall 42 has a flat surface extending into the hull 20 and joining to the floor 48 and ceiling 46 with rounded edges. As the gullet 40 transitions to a circular area at the pump inlet 50, the sidewalls 42 blend with the gullet ceiling 46 and gullet floor 48 to form a cylindrical surface.

Figure 5:
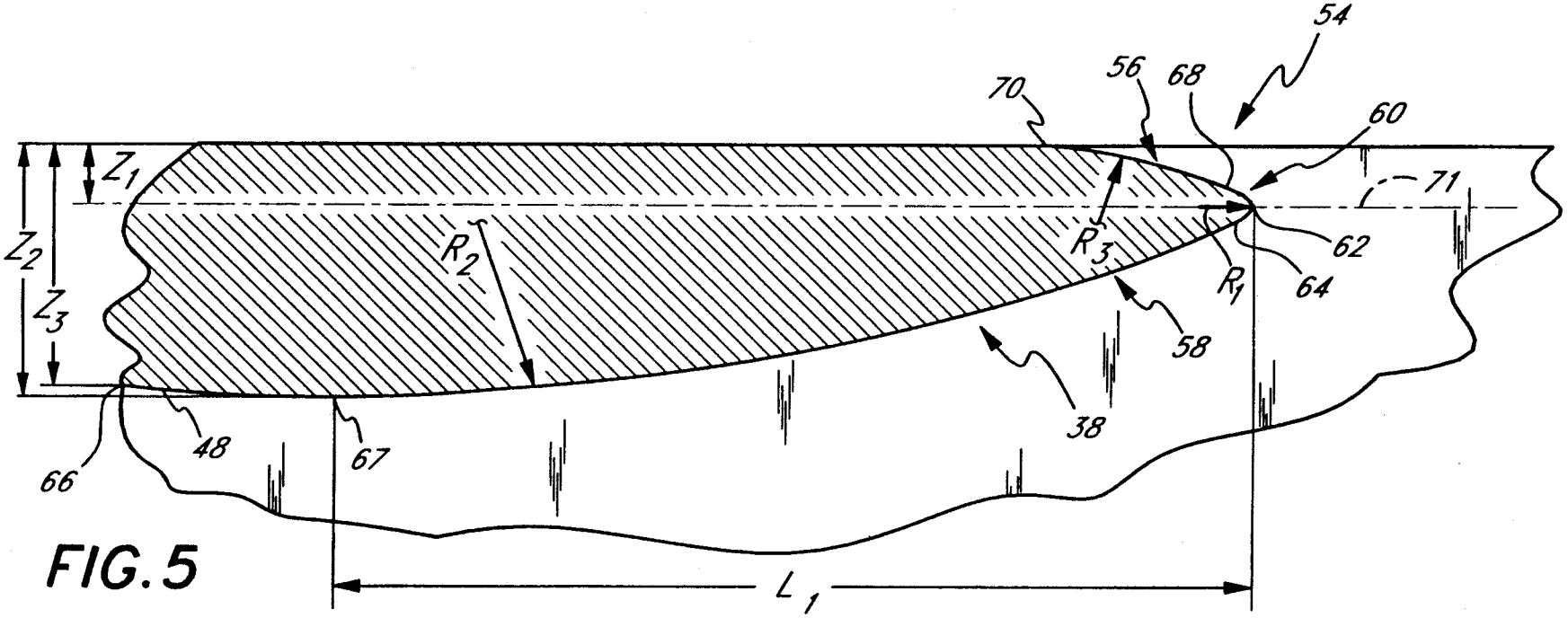
FIG. 5 is an enlarged cross-sectional view of the area within line 5—5 of FIG. 3, illustrating a nose of an entry edge.

Referring to FIG. 3, the foil-shaped cross section of the entry edge fin 38 is configured to increase water flow the gullet 40 and suppress turbulence downstream (i.e., towards the stern 14) of the entry edge fin 38. As shown in FIG. 5, the blunt nose 54 of the entry edge fin 38 comprises three surface portions, namely a keel surface portion 56 adjacent the keel line 36, a gullet surface portion 58 positioned above the keel surface portion 56 adjacent the gullet floor 48, and an apex surface portion 60 disposed therebetween.

As seen in FIG. 5, the three surface portions 56, 58, 60 of the nose 54 have different radii of curvature. The radius of curvature $R_1$ of the apex surface portion 60 is significantly smaller than the radii of curvature $R_2$, $R_3$ of the gullet surface portion 58 and the keel surface portion 56, respectively. In a preferred embodiment, the radius of curvature $R_1$ of the apex surface portion 60 equals about 3/64th of an inch. The radius of curvature $R_3$ of the keel surface portion 56 is also significantly smaller than the radius of curvature $R_2$ of the gullet surface portion 58. The radius of curvature $R_3$ of the keel surface portion 56 is sized to produce the desired amount of water flow into the gullet 40; if the radius of curvature $R_3$ is too large, the nose 54 will divert too much water away from the gullet and starve the pump 52. In the preferred embodiment, the radius of curvature $R_3$ of the keel surface portion 56 preferably equals about ¾th of an inch. The local radius of curvature $R_2$ of the gullet surface portion 58 is defined by the parabolic shape of the gullet surface portion 58 and the distance between the apex surface portion 56 and the gullet floor 48, as discussed below.

An apex 62, illustrated in FIG. 5, defines the farthest forward position of the nose 54. The apex surface portion 60 extends from the apex 62 to a first transition point 64 at the point of intersection between the apex surface portion 60 and the gullet surface portion 58. The gullet surface portion 58 extends from the first transition point 64 to a second transition point 66 at the point of intersection between the gullet surface portion 58 and the gullet floor 48. The gullet surface portion 58 blends 1 smoothly into the gullet floor 48. The gullet surface portion 58 has a parabolic shape with a vertex 67 (i.e., a point of the gullet surface portion 58 farthest away from the keel line 36 in the transverse direction) distanced from the apex by a longitudinal distance $L_1$. In a preferred embodiment, the distance $L_1$ is less than 6 inches, and preferably equals about 2 inches. The gullet surface portion 58 is spaced from the keel line 36 by a distance $Z_2$ at the vertex 67 and by a distance $Z_2$ at the second transition point 66. The distance $Z_2$ is larger than the distance $Z_3$ by about 10%, and in a preferred embodiment, the distance $Z_2$ is larger than the distance $Z_3$ by approximately 5%.

The apex surface 60 also extends from the apex 62 to a third transition point 68 at the point of intersection between the apex surface portion 60 and the keel surface portion 56. The first transition point 64 and the third transition point 68 are preferably equally distanced from the apex 62 as measured along the apex surface portion 60. The keel surface portion 56 extends from the third transition point 68 to a fourth transition point 70 at the point of intersection between the keel surface portion 56 and the bottom surface 32. The fourth transition point 70 is preferably significantly closer to the apex 62 than the second transition point 66.

As seen in FIG. 5, the three surface portions 56, 58, 60 form an asymmetric foil shape about a chord line 71. As used herein, "chord line" refers to a longitudinal line extending from the apex 62 of the nose 54 towards the stern 16 and parallel to the keel line 36. The chord line 71 is positioned closer to the keel surface portion 56 than to the gullet surface portion 58; however, the chord line 71 is positioned at or above the keel line 36. The chord line 71 is preferably offset above the keel line 36 by about 1/64th to ¾th of an inch, and more preferably by approximately 3/16th of an inch.

The nose 54 has a maximum transverse thickness equal to the dimension $Z_2$. This dimension $Z_2$ is significantly larger than a distance $Z_1$ between the chord line 71 and the keel line 36. The maximum thickness $Z_2$ preferably is about 4 times greater than the degree of chord line offset $Z_1$ from the keel line 36. The maximum thickness $Z_2$ in a preferred embodiment equals about ¾th of an inch.

The apex surface portion 60, being the farthest forward portion of the nose 54, provides a stagnation point about which the water flows above or below the entry edge fin 38. The stagnation point defines a point of zero velocity in the flow around nose 54. Fluid flowing over the apex surface portion 60 and the gullet surface portion 58 forms a boundary layer along these surfaces. The smooth transition between the apex surface portion 60, the gullet surface portion 58 and the gullet floor 48 spreads an inherent pressure rise over the distance $L_1$, such that the boundary layer along these surfaces remains substantially attached to these surfaces, thereby causing the flow to be substantially laminar.

In addition, the rounded, gradually tapering surfaces of the nose 54 and the gullet floor 48 also generally prevent boundary layer separation, which causes turbulence, by eliminating abrupt changes in curvature at the transitions between these surfaces. As a result, adverse pressure gradients do not occur along these surfaces and the boundary layer remains substantially attached to these surfaces.

Referring to FIG. 3, a cylindrical drive shaft 72 extends in the longitudinal direction from the motor 22, through the forward ramp 44, and across the length of the gullet 40. The drive shaft 72 connects to a pump impeller 74, rotationally driving it. The rotating drive shaft 72 creates a turbulent wake in the water flow through the gullet 40, downstream of and above the drive shaft 72.

To minimize the size of the wake created by the drive shaft 72 and to produce laminar flow before the pump inlet 50, the watercraft additionally includes a pair of gullet fins 76 extending from the forward ramp 44 in a direction generally normal to the forward ramp 44 towards the entry edge fin 38. As illustrated FIG. 6, the fins 76 are disposed on the either side of the drive shaft 72 and are generally parallel thereto in the longitudinal direction.

Figure 6:
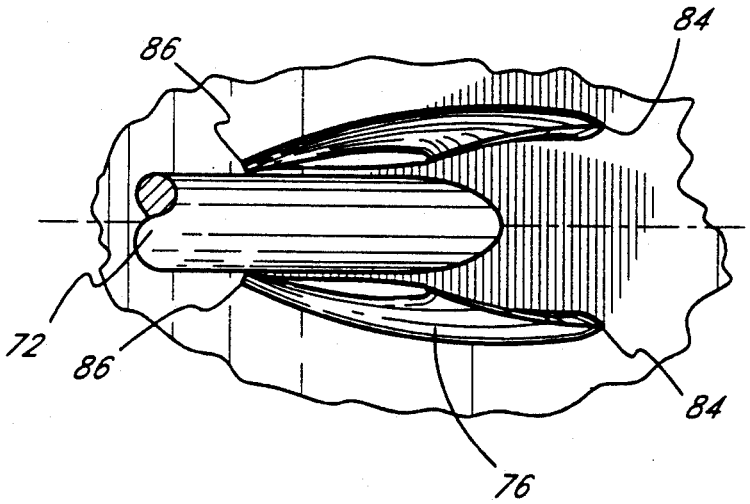
FIG. 6 is a partial plan view of a pair of gullet fins and a drive shaft of FIG. 3 as view along line 6—6.
Figure 7:
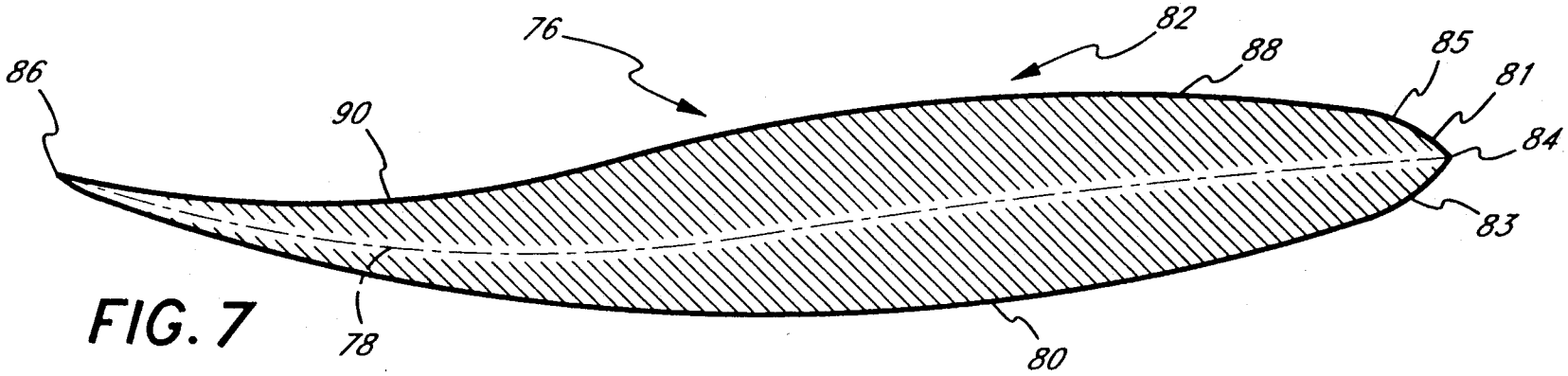
FIG. 7 is a cross-sectional view of the gullet fin of FIG. 3 taken along line 7—7.

Referring to FIG. 7, the gullet fins 76, in cross section, have an air-foil shape with a curved camber line 78. The camber line 78 represents the median curvature of the profile. In assembly, the camber line 78 of each gullet fin 76 Wraps around the drive shaft 72, as illustrated in FIG. 6. The gullet fins 76 have similar, but inverse shapes (i.e., mirror images) and are disposed at diametrically opposite sides of the drive shaft 72.

As illustrated in FIG. 7, each gullet fin 76 generally has a paisley shape defined between an outer arcuate surface 80 and an inner arcuate surface 82; each surface 80, 82 extends between a blunt nose 84 and a tail 86. As used herein, "paisley shape" is used to describe a structure with three distinct surface portions elongated in generally the same direction, one surface portion being concave and the other two surface portions being convex. Preferably, the blunt nose 84 has a radius of curvature equal to about 1/32nd of an inch. In a preferred embodiment, the nose 84 is defined by an apex surface portion 81, an outer surface portion 83 and an inner surface portion 85. The apex surface portion 81 has a radius of curvature significantly smaller that the radii of curvature of the inner surface portion 85 and the outer surface portion 83. The inner surface portion 85 has a radius of curvature matching that of the inner arcuate surface 82 proximate to the nose 84. The outer surface portion 83 has a radius of curvature matching that of the outer arcuate surface 80 proximate to the nose 84.

The inner surface 82 comprises a convex portion 88 and a concave portion 90. The convex portion 88 extends from the nose 84 and transitions into the concave portion 90 at approximately the mid-section of the gullet fin chord length.

Referring to FIG. 6, the gullet fin 76 are spaced apart from each other at their noses 84 by a distance greater than the distance between the gullet fin tails 86. The tails 86 are located proximal to the surface of the drive shaft 72, with a portion of the concave portion 90 of each gullet fin 76 adjacent to a surface portion of the drive shaft 72. As best seen in FIG. 3, the convex portions 88 of the gullet fins 76 are located upstream of drive shaft 72, and are closer to the keel line 36 than the drive shaft 72 is.

The gullet fins 76 route a substantial portion of the water flow around the shaft 72. The gullet fins 76 create a region of high pressure between the convex portions 88 upstream of the drive shaft 72; the region of high pressure impedes the water flow and thereby directs the flow over the outer surfaces 80 of the gullet fins 76. Additionally, the blunt nose 84 of each gullet fin 76 reduces turbulence, as described above in connection with the configuration of the entry edge fin 38.

As mentioned above, a turbulent wake forms downstream of the rotating cylindrical drive shaft 72. The concave portions 90 of the gullet fins 76 create a low pressure region which draws the wake towards the drive shaft 72 and thus produce a smaller size wake. As a result, the two water flow paths on the outer sides of the fins 76 join together before the pump inlet 50.

The spacing between the gullet fins 76 and the drive shaft 72 prevents objects the size of or larger than an adult human hand from fully inserting into the gullet 40. Thus, the gullet fins 76 serve two purposes; the gullets fins 76 act as a grating preventing hand-sized objects (e.g., a small fish) from entering the gullet 40 and also produce, in combination with the entry edge fin 38 and the low resistance gullet 40, substantially laminar flow before the pump inlet 50, thus improving pump performance.

Preferably, the gullet 40 and gullet fins 76 are integrally formed with the hull 20 during fabrication using fiberglass or another type of fiber reinforced resin. The entry edge fin 38 is preferably integrally casted with the pump housing and is formed of a metal alloy, such as, for example, a high strength aluminum alloy.

Figure 8:
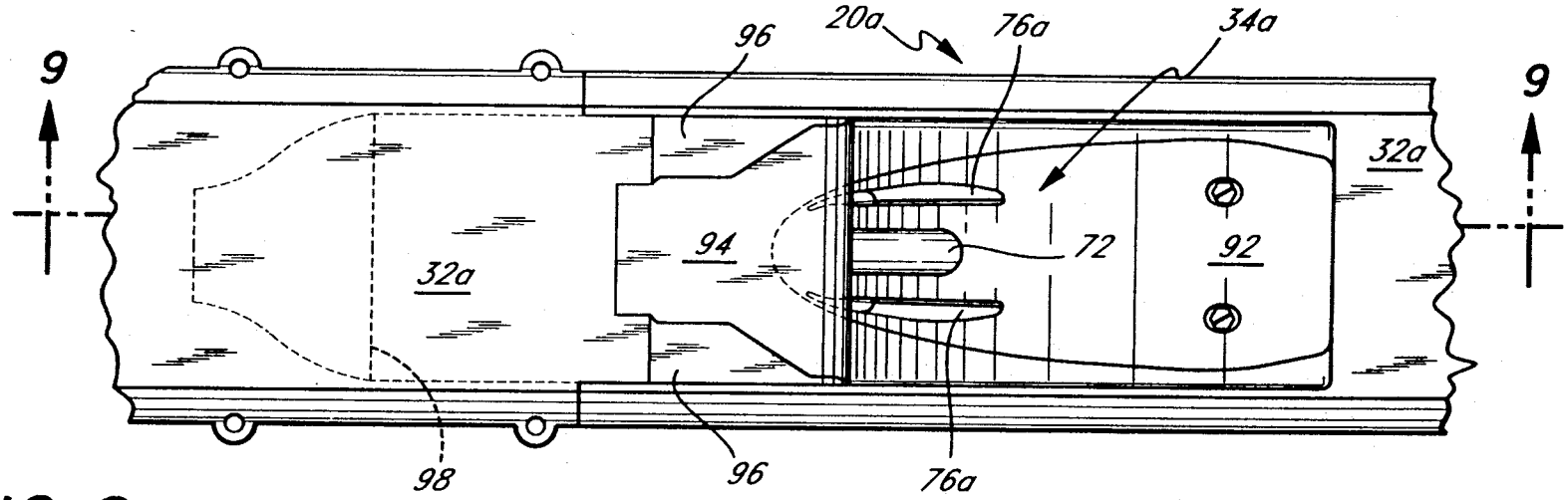
FIG. 8 is a partial bottom view of a personal watercraft in accordance with another embodiment of the present invention taken along the line 2—2 of FIG. 1.
Figure 9:
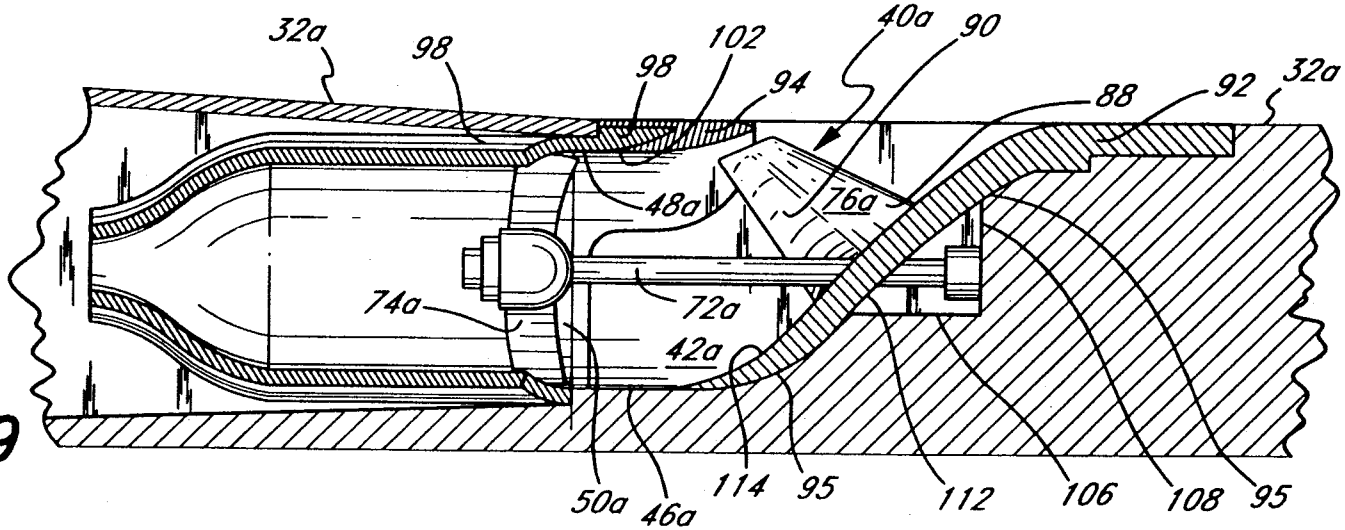
FIG. 9 is a cross-sectional view of a gullet of the personal watercraft of FIG. 8 taken along the line 9—9.

FIGS. 8 and 9 illustrate an alternative embodiment of the present invention applying a number of the aspects and advantages described above in a retrofit manner to improve the performance of an existing personal watercraft. A retrofit kit embodies a number of the principles of the present invention. The kit comprises a hull modification insert 92 and an entry edge fin insert 94. As installed, the kit produces a low resistance gullet configuration, similar to the embodiment described above.

FIGS. 8 and 9 illustrate a portion of a hull **20*a* of an existing personal watercraft 10*a* with the inserts 92, 94** installed. Where appropriate, like numbers with an "a" suffix are used to indicate like parts of the two embodiments for ease of understanding.

In order to appreciate the present embodiment, a basic understanding of the existing hull **20*a* is essential. Referring to FIG. 8, a bottom surface 32*a* of the hull 20*a* defines an intake aperture 34*a* opening into a water intake gullet 40*a*. The gullet 40*a*, as best seen in FIG. 9, is defined between a pair of sidewalls 42*a*, a forward ramp 95, a ceiling 46*a*, and a floor 48*a*. A pair of side sections 96 sections 96, as illustrated in FIG. 8, are oblique to the water flow in the plane of the intake aperture 34*a***.

A grating plate (not shown) conventionally extends from the pump housing 98, between the side sections 96, and across the intake aperture **34*a*. The grating plate attaches to the pump housing 98 and to the forward ramp 95 by fasteners, such as screws. With the grating plate removed, the entry edge fin insert 94 fits between the side sections 96 and is secured to the pump housing 98 by the fastener used to secure the grating plate. The entry edge fin insert 94 defines a linear entry edge fin 38*a* of the intake aperture 34*a* positioned perpendicular to the water flow. The entry edge fin 38*a* insert comprises a blunt nose 54*a* having an identical shape to that described above in connection with the first embodiment. The entry edge fin insert 94 additionally comprises a gullet floor portion 102 extending in the direction of the stern 14***a* from the nose 54*a*. The gullet floor portion 102 transforms from a substantially flat surface proximate to the nose 54*a* to an arcuate surface blending with the cylindrical shaped pump inlet 50*a*.

As illustrated in FIG. 9, the entry edge fin insert 94 further includes a engagement recess 104 which receives a portion of the pump housing 98 in assembly. The engagement recess 104 has a shape commensurate with the shape of the pump housing 98 between the side sections 96. As a result, the entry edge fin insert 94 forms a smooth transition with the bottom surface 32*a* and blends with the pump inlet 50*a*, as previously described. The entry edge fin insert 94 tightly fits in place, preventing water leakage between the insert 94 and the pump housing 98.

Referring to FIG. 9, the forward ramp 95 of the existing gullet 40*a* slopes from the aperture 34*a* to the gullet ceiling 46*a* and includes a step 106. A drive shaft 72*a* extends through a transverse wall 108 of the step 106 and across to gullet 40*a*. Proximate to the bottom surface 32*a*, the forward ramp 95 includes a second step 110 which normally receives the grating plate (not shown); the grating plate conventionally attaches to the forward ramp 95 by a pair of screws engaging threaded holes in the forward ramp.

The hull insert 92 is defined between an engagement surface 112 and a flow surface 114. The engagement surface 112, as illustrated in FIG. 9, has a shape commensurate with the shape of the forward ramp 95. The hull insert 92 snugly fits into the second step 110 and extends up the forward ramp 95, fully covering the first step 108. The hull insert 92 attaches to the forward ramp by the fasteners used to secured the grating plate in place.

The hull insert 92 forms a flush surface with the adjacent bottom surface 32*a* and extends in the longitudinal direction towards the stern 14*a*, constricting the intake aperture 34*a* to an area commensurate to the area of the pump inlet 50*a*. As a result, the hull insert 92 reduces a pressure drop which exists within the unmodified gullet 40*a* by producing an area of the intake aperture 34*a* matching the area of the pump inlet 50*a*.

The hull insert 92 tapers in cross section, as seen in FIG. 9, from the intake aperture 34*a* to the gullet ceiling 46*a*. The hull insert 92 and the entry edge fin insert 94 form a tunnel having a substantially uniform area through out the gullet 40*a*. Although the inserts reduce the volume of water flowing though the gullet 40*a*, the inserts eliminate the adverse pressure drop occurring within the unmodified gullet 40*a*.

The hull modification insert 92 includes gullet fins 76*a* integrally molded with the hull insert 92. The gullet fins 76*a* are configured and positioned within the gullet as previously described in connection with the first embodiment.

The inserts 92, 94 are preferably injection molded and constructed of polycarbonate or the like. Alternatively, fiberglass or other fiber-reinforced resins can be used as well.

This embodiment of the invention allows after market modifications to existing personal watercraft to provide a number of the aforementioned advantages of the low resistance gullet 40, the entry edge fin 38 configuration and the gullet fins 76 design. The insert kit greatly improves the performance of the modified personal watercraft at minimum cost. In addition, the inserts 92, 94 easy install without extensive modification to the watercraft.

Although this invention is described in terms of certain preferred embodiments, other embodiments that will be apparent to those of ordinary skill in the art are also within the scope of this invention. Accordingly, the scope of the invention is intended to be defined by the claims which follow.

What is claimed is:

1. A hydraulic intake for a personal watercraft propulsion system, said intake comprising:

a gullet having a forward ramp;

a drive shaft extending from said forward ramp generally in the longitudinal direction; and a gullet fin extending from said forward ramp and being disposed about said drive shaft, said gullet fin having an air-foil cross-sectional shape with a camber line curving partially around said drive shaft, said cross-sectional shape being configured to produce a laminar flow downstream of said drive shaft.

2. The intake of claim 1, wherein said gullet fin comprises an inner surface having a concave portion proximate to a tail of said fin reducing the size of a wake downstream of said drive shaft.

3. The intake of claim 1, wherein said gullet fin generally has a paisley shape.

4. The intake of claim 1, additionally comprising a second gullet fin having a shape similar, but inverse to said first gullet fin, said first gullet fin and second gullet fin being disposed diametrically opposite from each other about said drive shaft.

5. The intake of claim 4, wherein said first gullet fin and said second gullet fin are spaced laterally from said drive shaft.

6. The intake of claim 5, wherein said firs gullet fin and said second gullet fin each comprise tails, said tails being disposed in the transverse direction proximate to a longitudinal axis of the drive shaft.

7. The intake of claim 5, wherein said first gullet fin and said second gullet fin are disposed in the lateral direction proximate to an external surface of the drive shaft.

8. The intake of claim 4, wherein said gullet fins are sufficiently spaced apart form each other and from said drive shaft to prevent hand-sized objects from entering a pump inlet downstream of said gullet.

9. A kit for modifying an existing personal watercraft propulsion system intake, said kit comprising:

a entry edge insert comprising a nose portion having a blunt configuration for improving hydrodynamic flow through said intake; and a hull insert having a smooth forward ramp surface and defining an aperture to receive a drive shaft of said propulsion system, said hull insert being configured to produce a gullet having a substantially uniform flow area throughout said gullet, wherein said hull insert comprises gullet fins extending across said gullet and being positioned to prevent hand-sized objects from entering said propulsion system, and wherein said gullet fins have an air-foil cross-sectional shape with a camber line curving partially around said drive shaft, said cross-sectional shape being configured to produce a substantially laminar flow downstream of said drive shaft.

10. A kit of claim 9, wherein said nose portion is linear in the lateral direction.

11. A kit for modifying an existing personal watercraft, said existing watercraft having a hydraulic system intake, a pump inlet, and a gullet between said intake and said pump inlet, said gullet of said existing watercraft having a non-uniform flow area, said kit comprising:

a fin-shaped entry edge foil for modifying a leading edge of said intake, said foil extending longitudinally from said intake towards said pump inlet along a keel line and comprising a blunt nose portion configured to provide substantially laminar flow of water through said intake adjacent said foil, said foil having a maximum transverse thickness proximate to said keel line of no more than 20% of the diameter of the pump inlet; and a hull insert for placement within said existing non-uniform flow area of said existing watercraft gullet for reducing the size of at least a portion of said gullet, said hull insert being configured to produce a modified gullet having a flow area taken across a plane perpendicular to the water flow through the gullet which is substantially uniform throughout said modified gullet between said intake and said pump inlet, whereby said kit produces a substantially laminar flow of water through said modified gullet.

* * * * *